United States Patent [19]

Fichtl et al.

[11] 4,211,164

[45] Jul. 8, 1980

[54] ROTARY DRUM-TYPE COLLECTING VESSEL WITH A RAKING AND PRESSING SCREW

[75] Inventors: Karl Fichtl, Augsburg; Rudolf Berger, Friedberg; Otto Dürnfelder, Augsburg; Erich Pilz, Gersthofen, all of Fed. Rep. of Germany

[73] Assignee: Industrie-Werke Karisruhe-Augsburg Aktiengesellschaft, Fed. Rep. of Germany

[21] Appl. No.: 2,340

[22] Filed: Jan. 10, 1979

[30] Foreign Application Priority Data

Jan. 21, 1978 [DE] Fed. Rep. of Germany ..... 2802653

[51] Int. Cl.[2] ..... B30B 3/02

[52] U.S. Cl. ..... 100/145; 366/319

[58] Field of Search ..... 100/145, 146, 147, 148, 100/149, 150, 117; 366/133, 156, 266, 318, 319

[56] References Cited

U.S. PATENT DOCUMENTS

| | | | |
|---|---|---|---|
| 3,753,399 | 8/1973 | Dessoris | 100/145 |
| 3,779,033 | 12/1973 | Swanson | 100/145 |
| 3,812,985 | 5/1974 | Lindeberg | 100/145 |
| 4,041,854 | 8/1977 | Cox | 100/145 |

*Primary Examiner*—Edward J. McCarthy
*Attorney, Agent, or Firm*—McGlew and Tuttle

[57] ABSTRACT

A rotary drum-type collecting vessel for receiving and transporting refuse or other bulk material, comprises, a hollow rotary collecting drum having an inside wall, and includes an opening at one end which is covered by a cover plate which covers the opening and has a frusto conical interior surface which projects into the collecting drum. The frusto conical surface terminates in a frustum plane within the drum. It includes a lower portion with a charge opening and it carries a spirally extending feed blade on its surface with pushing elements in the form of ribs defined therealong and rotating therewith so as to force bulk material in an action, such as by a raking worm, into the collecting drum. The material is also pressed therein by an action such that by a thrust worm in a zone between the inside wall of the rotary drum and the frustum plane. The pushing element ribs extend from the upper vertex point of the frusto conical surface up to over the entire charge opening at the inside plane of the surface and enlarging radially to such an extent so as to keep the outer bore uniformly spaced from the ribs. An additional compressing means is associated with the drum and they are effective in the zone of the frustum plane and are advantageously comprised of a spiral screw which is attached to the inside plane of the frustum. The screw may be firmly attached to the frustum of the cover or it may be arranged on the inside plane of the frustum and driven by its separate drive. The direction of rotation is advantageously opposite to that of the rotation of the frustum surface.

5 Claims, 12 Drawing Figures

ROTARY DRUM-TYPE COLLECTING VESSEL WITH A RAKING AND PRESSING SCREW

FIELD AND BACKGROUND OF THE INVENTION

This invention relates to the construction of vessels in general and, in particular, to a new and useful rotary drum-type collecting vessel having a raking and pressing screw associated therewith.

DESCRIPTION OF THE PRIOR ART

A rotary collecting vessel is known from German Pat. No. 1,144,185 and its substantial elements are shown in FIG. 1 (Prior Art). They include a rotary drum T having its rear end closed by a cover A. This cover, which is tiltable relative to the undercarriage of a vehicle transporting the rotary collecting drum, carries a hollow truncated cone or frustum 3 projecting to the interior of the rotary drum and supporting a spiral feed blade 2 secured thereto on its outside and extending from an upper vertex S through about 180° to a point E in the inside plane of the frustum 3, thus exhibiting a pitch covering within this angular range the entire depth of the frustum 3. The feed blade 2 then extends through an additional 90° in the radial direction, but only in the form of a circular segment 4, without a pitch. This circular segment 4 serves the purpose of preventing the material transferred from a charge space 5, by the action of the spiral feed blade 2 in cooperation with the pushing ribs 1 which extend axially in the cover and into the interior of the drum from falling back into the charge space.

Consequently, the raking work is performed only by the spiral turn of the feed blade extending through 180°, the minimum pitch of the spiral being determined or limited by the depth of the charge space needed in the frustum or by the height of the frustum itself.

The mentioned effect of the circular segment provided as an extension of the feed blade is also important in respect to the compression of the bulk material in the interior of the rotary drum. Since the bulk material is prevented from falling back into the charge inlet and, on the other hand, new bulk material is continuously fed in by the feed blades acting as a raking screw, the circular segment serves as a thrust screw for compressing the bulk material in the interior of the rotary drum.

Taking the specific design of German Pat. No. 1,144,185 as a basis, the conditions are such that the compression produces its effect only within an annular area having its inner diameter equal to the frustum diameter d adjacent the rotary drum and its outer diameter D determined by the diameter of the rotary drum minus the height of the pushing ribs provided on the rotary drum. Due to the difference in the superficial pressure on the entire bulk material filled in, the greatest compression of the bulk material is obtained in the annular zone, close in front of the circular segment of the feed blade. The compression of the bulk material decreases with the increasing distance from the feed blade which acts as a raking and pressing screw.

SUMMARY OF THE INVENTION

The present invention is directed to a rotary drum-type collecting vessel with a raking and pressing screw which ensures that a more uniform compression effect is produced on the bulk material in the vessel or drum over its entire circular area and not only in a particular annular area. In accordance with the invention, additional compression means are provided which act in the zone of the inside plane of the frustum.

Accordingly, an object of the present invention is to provide a rotary drum-type collecting vessel for receiving and transporting refuse or other bulk material which comprises a hollow rotary collecting drum having an inside wall and an end opening which is covered by a hollow cover plate with a frusto conical interior surface which projects into the collecting drum and which terminates in a frustum plane within the drum and, wherein, the cover has a charge opening at its lower end and carries a spirally extending feed blade on its surface with pushing elements which rotate therewith so as to force the bulk material into the collecting drum where it is pressed therein in a zone between the inside wall of the drum and the frustum plane, the pushing elements comprising ribs extending from the upper vertex plane of the frusto conical surface up to over the entire charge opening at the inside plane of the surface and they enlarge radially to an extent so as to keep the outer border uniformly spaced from the ribs and which further includes additional compressing means associated with the drum which are effective in the zone of the frustum plane and which advantageously comprise a screw.

A further object of the present invention is to provide a rotary drum-type collecting vessel having a raking and pressing screw which is simple in design, rugged in construction and economical to manufacture.

For an understanding of the principles of the invention, reference is made to the following description of typical embodiments thereof as illustrated in the accompanying drawings.

DESCRIPTION OF THE PREFERRED EMBODIMENTS

Figure 1:
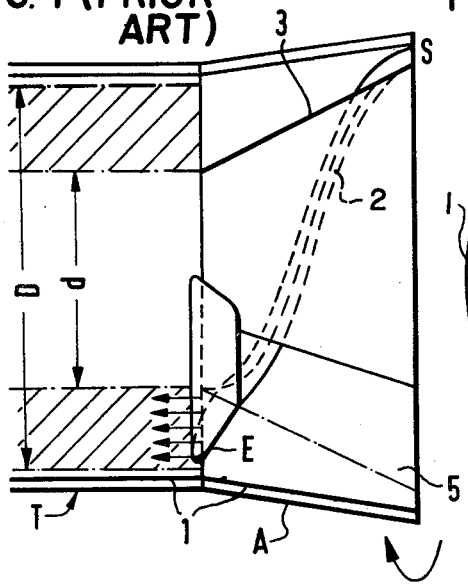
FIG. 1 (PRIOR ART)
FIG. 1 is a partial sectional view of a rotary drum-type collecting vessel for receiving and transporting refuse constructed in accordance with the Prior Art.
Figure 1A:
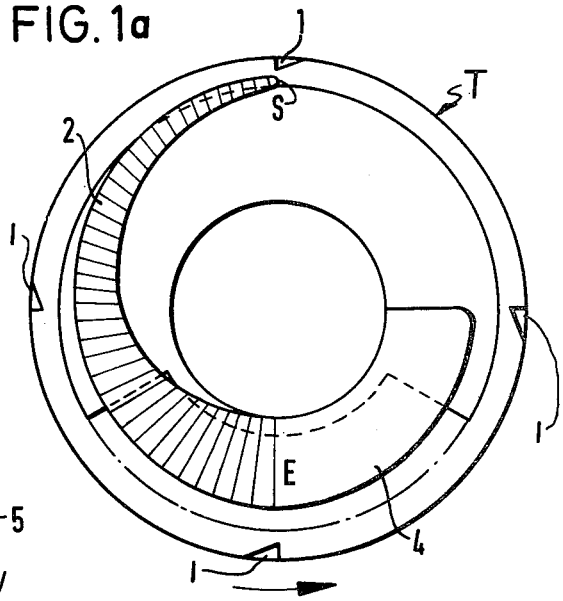
FIG. 1a (PRIOR ART)
FIG. 1*a* is an end elevational view of the vessel of the prior art shown in FIG. 1.

Referring to the drawings in particular, the invention embodied therein, comprises, a rotary drum-type collecting vessel, generally designated 50, which includes the hollow drum portion, which is similar to the drum, generally designated T of the prior art and which has a hollow cover closing one end, generally designated 52, which is similar to the cover designated A in FIG. 1 (Prior Art).

The basic design of the rotary drum-type collecting vessel of the prior art has already been described in connection with FIG. 1 and it should be pointed out explicitly that the additional compression means provided in accordance with the invention can be mounted at any time ex post on such a known rotary drum-type collecting vessel as well.

Figure 2:
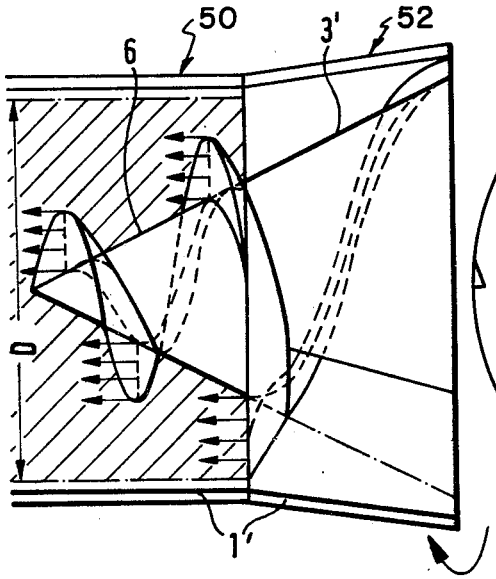
FIG. 2 is a partial sectional view of a rotary drum-type collecting vessel for receiving and transporting refuse constructed in accordance with the present invention.
Figure 2A:
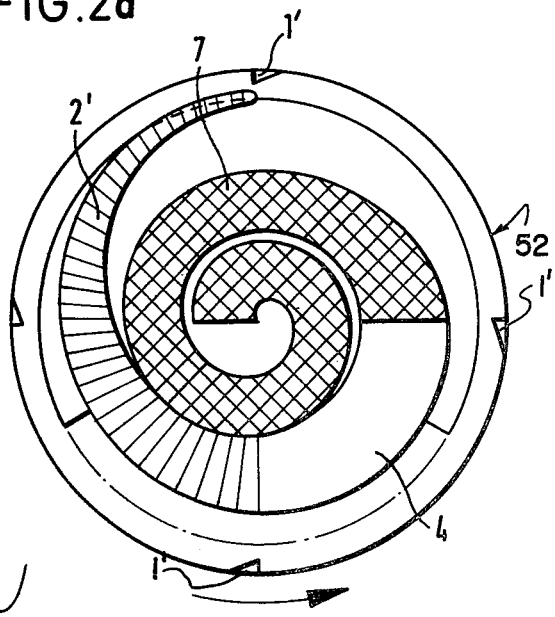
FIG. 2*a* is an end elevational view of the vessel shown in FIG. 2.

In the embodiment of FIGS. 2 and 2*a*, a frustum 3' is extended to a full cone 6 having the same conicity. On the conical extension 6 of the frustum, another spiral blade 7 is provided as an extension of a feed blade 2' or as an extension of the circular segment extension 4 of FIG. 1. This second spiral 7 has a smaller pitch and height than the spiral feed blade 2 of the prior art, and extends up to the apex of cone 6. Due to this concept, the entire cross-section of the collecting drum is covered by the spiral, so that bulk material compression takes place over the entire cross-section. The height and pitch of the spiral provided on the additional cone are to be chosen so as to reach the goal of a full coverage of the area.

Figure 3:
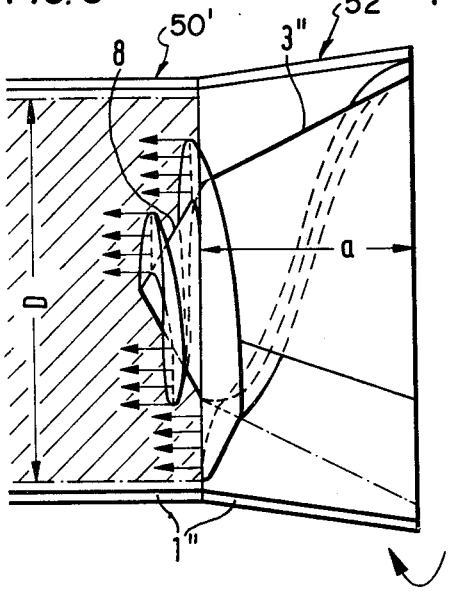
FIGS. 3, 4, 5, 6 and 7 are views similar to FIG. 2 of other embodiments of the invention.
Figure 3A:
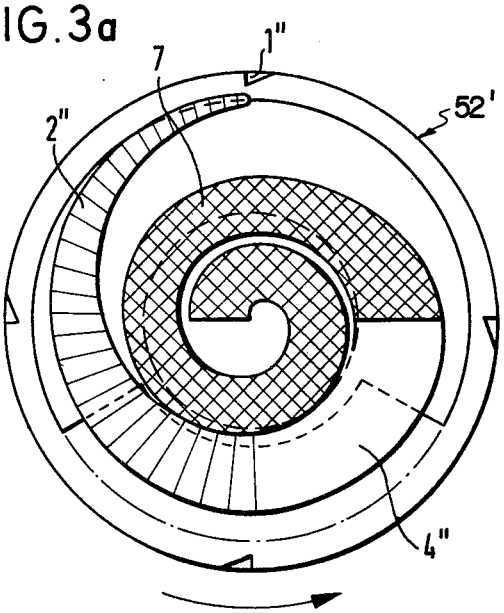
FIGS. 3*a*, 4*a* and 5*a* are end elevational views similar to FIG. 2*a* of the respective embodiments shown in FIGS. 3, 4 and 5.

Since the enlargement of the frustum to a full cone reduces the load capacity of the collecting drum and thus its efficiency in application, a cone 8 may be provided in accordance with the embodiment of FIGS. 3 and 3*a* having a substantially larger vertex angle. In this embodiment again, a spiral 2'' of the frustum is extended with a smaller pitch and height up to the apex of an added cone 8, whereby, the entire cross-section of the vessel is covered by the spiral blade.

Figure 4:
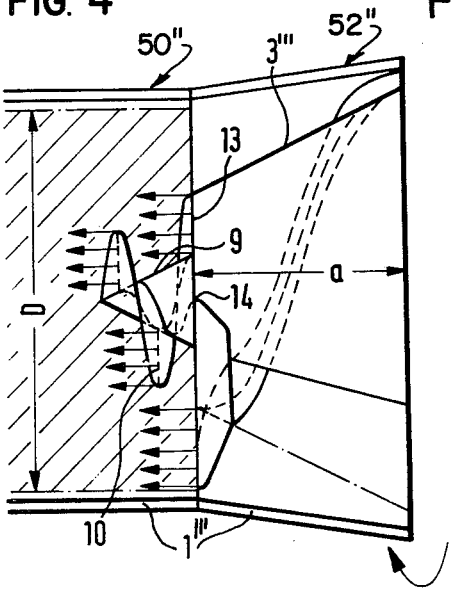
Figure 4A:
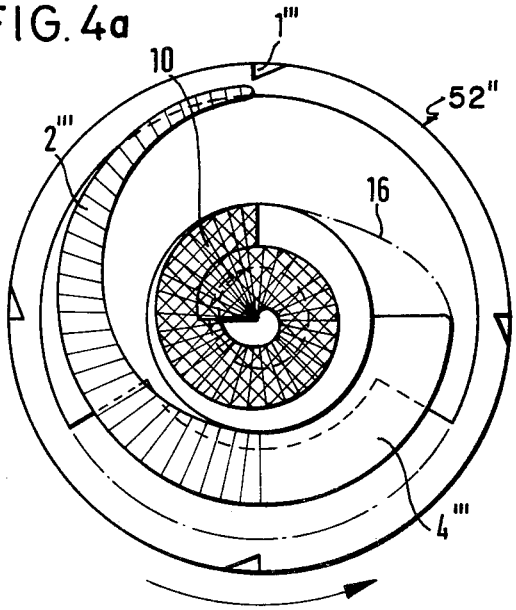

FIGS. 4 and 4*a* show a variation of the embodiment of FIGS. 3 and 3*a*. Here, a cone 9 having a smaller base and the same vertex angle is added on the top surface of the frustum. This cone 9 is again embraced by a spiral blade 10 which is a continuation of the frustum spiral 2'''. The pitch and height of this additional spiral blade 10 are smaller than that of the frustum and dimensioned for covering the entire cross-section of the vessel.

Figure 5:
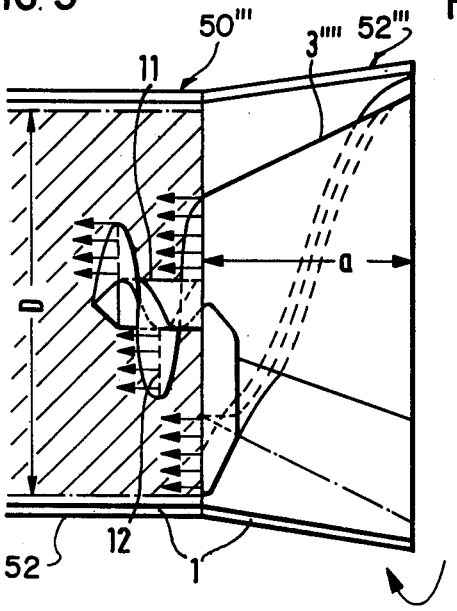
Figure 5A:
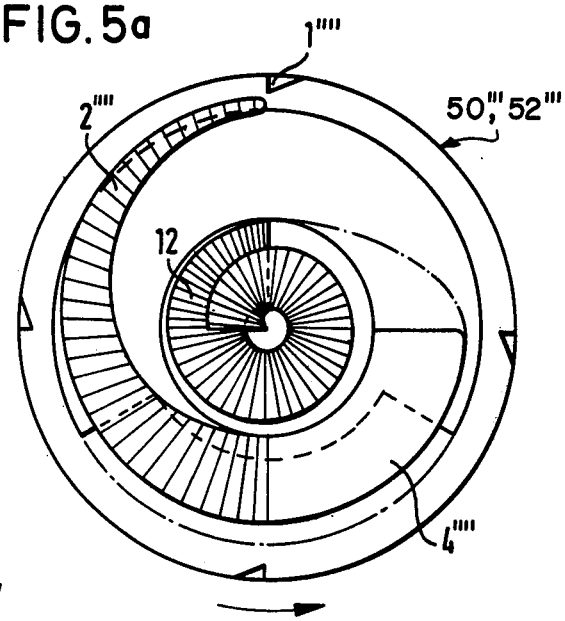
Figure 6:
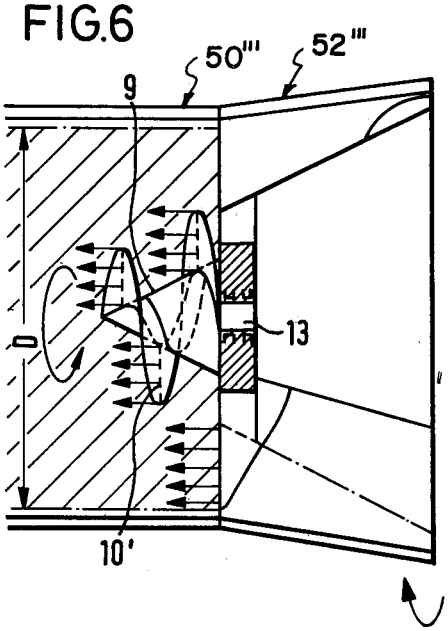
Figure 7:
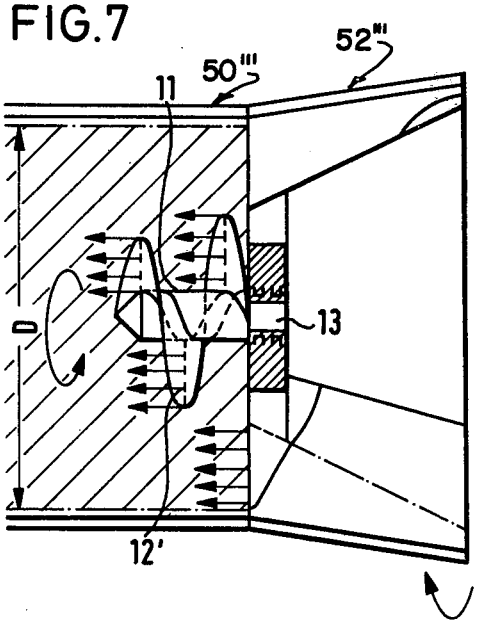

Another modification of the inventive additional compression means is shown in FIGS. 5 and 5*a*. In this example, the frustum is extended by a mandrel 11 projecting from the center of the inside frustum plane. A spiral screw or blade 12 extends around this mandrel as prolongation of the spiral on the frustum and its height is determined by the inside diameter of the frustum and the diameter of the mandrel. This ensures that the entire cross-section of the vessel is covered. FIGS. 6 and 7 show two embodiments of the invention in which the geometry of the additional compression means corresponds to that of the embodiments of FIGS. 4 and 5. The only difference is that here the additional spiral screws have their own drive 13 which is provided centrally in the frustum. According to a particular provision of the invention, the direction of rotation of this drive is such that the additional compression means rotate in the opposite direction relative to the direction of rotation of the frustum, whereby, the conveying effect of the additional spirals is increased.

Since the drives in the two last-named embodiments are self-contained, the respective additional spiral screws 10' or 12' are not connected to the spiral blade of the frustum. In this connection, it should be pointed out that in the embodiments of FIGS. 2 to 5 also, it is not necessary to have the additional screws connected to or extending in immediate prolongation of the spiral screw of the frustum.

The invention makes it possible to expose not only the annular zone between the inside frustum plane and the diameter of the vessel, as in the prior art, but the entire circular area of the rotary collecting drum to the conveying effect and thrust of a screw, with the effect of the screw being produced by a screw of the prior art and the inventive additional screw. This ensures a more uniform and more complete compression of the bulk material in the collecting vessel. In addition, and in accordance with the inventive concept, the main compressing work is performed after the charging into the collecting vessel by the additional spiral screw. The additional screw conveys the bulk material into the center of the rotating drum and the main compression takes place there.

While specific embodiments of the invention have been shown and described in detail to illustrate the application of the principles of the invention, it will be understood that the invention may be embodied otherwise without departing from such principles.

What is claimed is:

1. A rotary drum-type collecting vessel for receiving and transporting refuse or other bulk material, comprising, a hollow rotary collecting drum having an inside wall and an end opening, a hollow cover plate covering said opening with a frusto conical interior surface which projects into the collecting drum, said surface terminating in a frustum plane within said drum, and having a lower portion with a charge opening and carrying a spirally extending feed blade on said surface, pushing element means provided on the inside surface of the rotary drum and rotating therewith so as to force the bulk material, as by a raking worm, into the collecting drum and pressed therein, as by a thrust worm, in a zone between said inside wall of the rotary drum and said frustum plane, said pushing element means comprising ribs, said feed blade extending from the upper vertex point of said frusto conical surface up to over the entire charge opening at the inside plane of said surface and enlarging radially to such an extent as to keep its outer border uniformly space from said ribs, and additional compressing means associated with said drum and effective in the zone of said frustum plane.

2. A rotary drum-type collecting vessel, as claimed in claim 1, wherein said additional compressing means comprises a spiral screw attached to said cover adjacent said frustum plane.

3. A rotary drum-type collecting vessel, as claimed in claim 2, wherein said screw is affixed to said cover for rotation with said surface.

4. A rotary drum-type collecting vessel, as claimed in claim 1, wherein said additional compressing means comprises a rotatable screw arranged adjacent said frustum plane and mounting drive means connected to said screw for rotating said screw.

5. A rotary drum-type collecting vessel, as claimed in claim 4, wherein said drive means drive said screw in a direction opposite to said surface.

* * * * *